United States Patent [19]

Jones

[11] 4,279,307

[45] Jul. 21, 1981

[54] NATURAL GAS PRODUCTION FROM GEOPRESSURED AQUIFERS

[75] Inventor: Paul H. Jones, Baton Rouge, La.

[73] Assignee: P. H. Jones Hydrogeology, Inc., Baton Rouge, La.

[21] Appl. No.: 19,122

[22] Filed: Mar. 9, 1979

[51] Int. Cl.[3] ..... E21B 33/072; E21B 33/127; E21B 43/12; E21B 43/30

[52] U.S. Cl. ..... 166/314; 166/52; 166/72; 166/245; 166/267

[58] Field of Search ..... 166/314, 52, 250, 123, 166/187, 245, 75 R, 72, 267, 67

[56] References Cited

U.S. PATENT DOCUMENTS

| | | | |
|---|---|---|---|
| 2,077,912 | 4/1937 | Van Vorhis | 166/265 |
| 3,132,692 | 5/1964 | Marx et al. | 166/245 |
| 3,258,069 | 6/1966 | Hottman | 166/252 |
| 4,040,487 | 8/1977 | Cook, Jr. et al. | 166/314 |
| 4,042,034 | 8/1977 | Cook, Jr. et al. | 166/314 |
| 4,116,276 | 9/1978 | Cook, Jr. et al. | 166/314 |
| 4,149,596 | 4/1979 | Richardson et al. | 166/314 |
| 4,149,598 | 4/1979 | Christian | 166/314 |

OTHER PUBLICATIONS

Mac Elvain, "Mechanics of Gaseous Ascension Through a Sedimentary Column," pp. 15–27, Proceedings of Symposium on Unconventional Methods in Exploration for Petroleum and Natural Gas, Institute for the Study of Earth and Man, Southern Methodist University, Dallas, Tex. 1969.

Hammerlindly, "Predicting Gas Reserves in Abnormally Pressured Reservoirs," SPE preprint 3479, 6 p., 4 figs.: Society of Petroleum Engineers of AIME, Dallas, Texas, 1971.

Perry, "Statistical Study of Geopressured Reservoirs in Southwest Louisiana," SPE preprint 3888, 3 p., 4 tables, 6 figs.: Society of Petroleum Engineers of AIME, Dallas, Texas, 1972.

Sultanov, et al., "Solubility of Methane in Water at High Temperatures and Pressures," Gazovaia promphlennost, vol. 17, No. 5, pp. 6–7, May 1, 1972.

Jones, "Natural Gas Resources of the Geopressured Zones in the Northern Gulf of Mexico Basin," pp. 17–33, Natural Gas from Unconventional Geologic Sources, Board on Mineral Resources, Commission on Natural Resources, National Academy of Sciences, Washington, D. C., 1976.

Randolph, "Natural Gas from Geopressured Aquifers," SPE preprint 6826, 8 pl, 1 table, 8 figs.: Society of Petroleum Engineers of AIME, Dallas, Texas, 1977.

Karkalits et al., "Chemical Analysis of Gas Dissolved in Geothermal Waters in a South Louisiana Well," from Proceedings of the Third Geopressured Geothermal Energy Conference, v. 2, pp. ED-41-66, University of Southwestern Louisiana, Lafayette, La., 1977.

Jones, "The Role of Geopressure in the Fluid Hydrocarbon Regime," in Exploration and Economics of the Petroleum Industry, Southwestern Legal Foundation, v. 16, pp. 211–227, Dallas, Texas, 1978.

Jones, "Geopressured-Geothermal Test of the Edna Delcambre No. 1 Well, Tigre Lagoon Field, Vermilion Parish, Louisiana: Geology of the Tigre Lagoon Field," 49 p., 3 tables, 17 figs.: McNeese State University, Lake Charles, La., 1978.

*Primary Examiner*—Stephen J. Novosad
*Attorney, Agent, or Firm*—Fleit & Jacobson

[57] ABSTRACT

A method of natural gas production from wells drilled into geopressured aquifers containing methane saturated water, comprising using wells which permit initial flow of water with a complete absence of back pressure at the well head, and containing the flow of water until loss of pressure in the aquifer exsolves sufficient gas to reverse the gas/water permeability ratio, thus converting the flow entirely to natural gas and water vapor and creating a gas cap. A further embodiment is the subsequent use of rings of secondary wells of similar design, each ring located at approximately equal radial distances from the initial well, to produce similar gas caps which interact with-, and produce from-, the gas cap created by production from the initial well and the gas caps of the other secondary wells.

36 Claims, 7 Drawing Figures

Design of a well to produce fluids under controlled blowout conditions.

Design of a well to produce fluids under controlled blowout conditions.

Cone of pressure relief and initial development conditions in production aquifer a few days after controlled blowout is established.

Configuration of articial gas cap created by controlled blowout, after a few weeks of production.

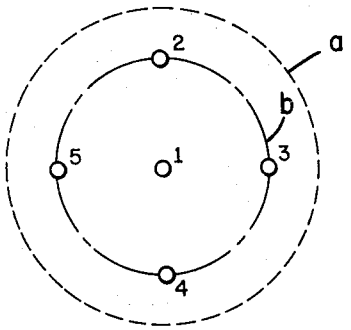
FIG. 4a
FIG. 4b
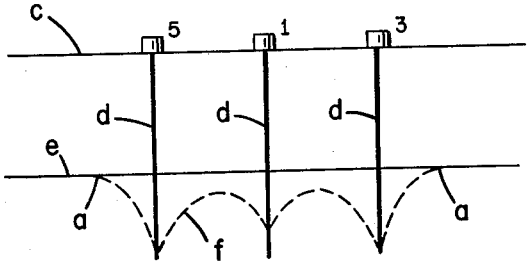
FIG. 5a
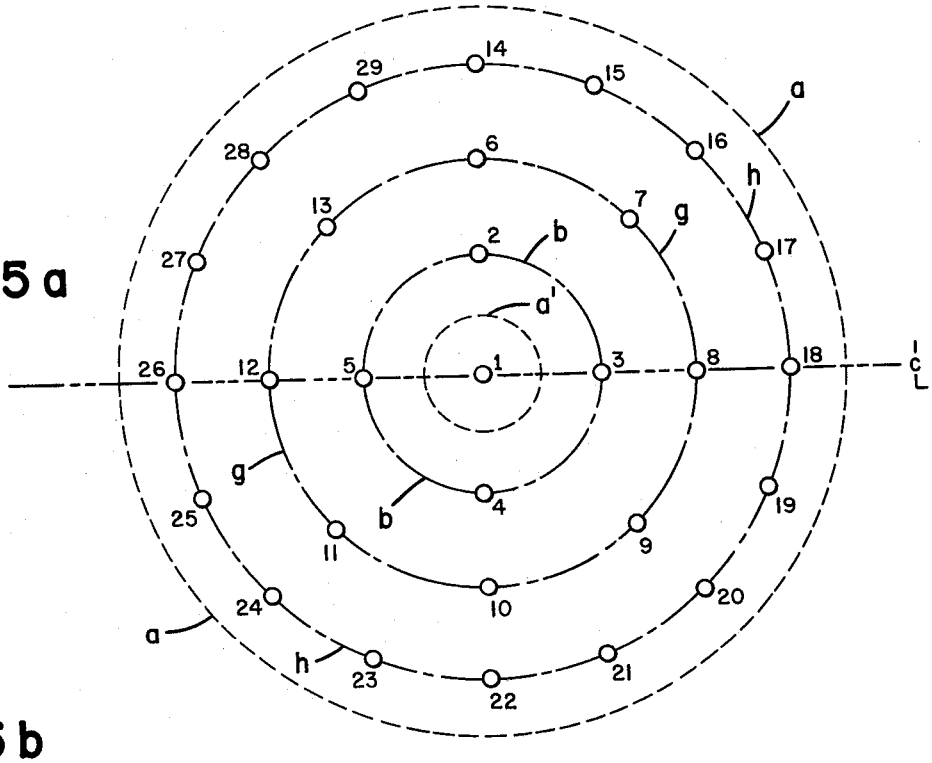
FIG. 5b
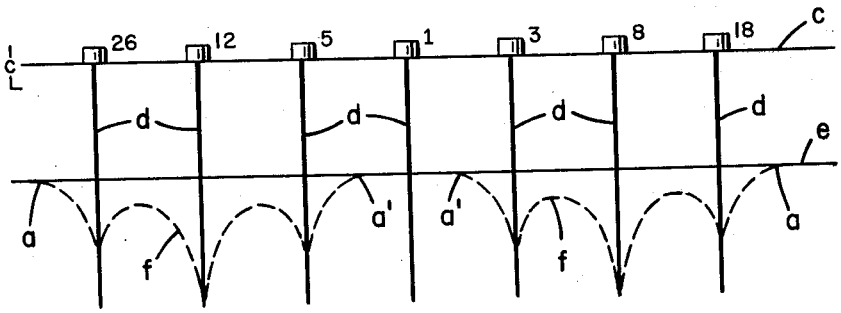
Legend for FIGS. 4a & b, 5a & b
- a = outer edge of gas cap
- a' = inner edge of gas cap
- b = first ring of wells
- c = land surface
- d = well bore
- e = upper level of aquifer
- f = gas cap/water interface
- g = second ring of wells
- h = third ring of wells

NATURAL GAS PRODUCTION FROM GEOPRESSURED AQUIFERS

BACKGROUND OF THE INVENTION

1. Field of the Invention

This invention relates to a method and apparatus for creating, producing, enlarging, and depleting artificial natural gas reservoirs in geopressured aquifers in which the waters are at or near methane saturation; or, in which low free gas saturations occur, not producible by conventional gas well completion methods.

2. Description of the Prior Art

Geopressured aquifers are water filled porous rock deposits (surrounded by relatively impervious rock deposits) which exhibit much higher pressure than is normal for water-bearing sands. Geopressured aquifers exist along the Gulf Coast of the United States and in many other places throughout the world where sedimentary deposits have been rapidly buried. Due to the high pressures found in geopressured aquifers, if a well is drilled into the aquifer, water will flow to the surface of the ground in artesian fashion. Natural gas may be present in geopressured aquifers in any of these forms:

(1) Gas dissolved in the water, (2) Free gas dispersed in water within the rock pores, and (3) A free gas phase present within the rock pores and separate from the water.

The conventional method of producing hydrocarbon fluids from oil and gas wells is designed to restrict the flow rate so as not to reduce drastically the fluid pressure in the vicinity of the production well which would cause intrusion of water into the well. In order to do this, the well casing is perforated in a zone above the oil-water or gas-water interface. Conventionally, gas well production ceases when water invades the area surrounding the well bore and appreciable quantities of water are produced with the gas.

Publications which relate to the background of this invention and which are referred to herein are as follows.

1. Mac Elvain, "Mechanics of Gaseous Ascension Through a Sedimentary Column," Pp. 15–27, Proceedings of Symposium on Unconventional Methods in Exploration for Petroleum and Natural Gas, Institute for the Study of Earth and Man, Southern Methodist University, Dallas, Texas, 1969.

2. Jones, "Hydrodynamics of Geopressure in the Northern Gulf of Mexico Basin," Jour. Petroleum Technology, v. 21, Pp. 803–810, 1969

3. Stuart, "Geopressures," in supplement to Proceedings of the Second Symposium on Abnormal Subsurface Pressure, Louisiana State University, Baton Rouge, La., 121 p., 1970

4. Hammerlindl, "Predicting Gas Reserves in Abnormally Pressurized Reservoirs," SPE preprint 3479, 6 p., 4 FIGS: Society of Petroleum Engineers of AIME, Dallas, Texas, 1971

5. Perry, "Statistical Study of Geopressured Reservoirs in Southwest Louisiana," SPE preprint 3888, 3 p., 4 tables, 6 FIGS: Society of Petroleum Engineers of AIME, Dallas, Texas 1972

6. Sultanov, et al, "Solubility of Methane in Water at High Temperatures and Pressures," Gazovaia promphlennost, v. 17, no. 5, Pp. 6–7, May 1, 1972

7. Jones, "Natural Gas Resources of the Geopressured Zones in the Northern Gulf of Mexico Basin," Pp. 17–33, Natural Gas from Unconventional Geologic Sources, Board on Mineral Resources, Commission on Natural Resources, National Academy of Sciences, Washington, D.C. 1976

8. Randolph, "Natural Gas from Geopressured Aquifers," SPE preprint 6826, 8 p., 1 table, 8 FIGS: Society of Petroleum Engineers of AIME, Dallas, Texas, 1977

9. Karkalits and Hankins, "Chemical Analysis of Gas Dissolved in Geothermal Waters in a South Louisiana Well" in the Proceedings of the Third Geopressured Geothermal Energy Conference, v. 2, Pp. ED-41–66, University of Southwestern Louisiana, Lafayette, La. 1977

10. Jones, "The Role of Geopressure in the Fluid Hydrocarbon Regime," in Exploration and Economics of the Petroleum Industry, Southwestern Legal Foundation, v. 16, Pp. 211–227, Dallas, Texas, 1978.

11. Jones, "Geopressured-Geothermal Test of the Edna Delcambre No. 1 Well, Tigre Lagoon Field, Vermilion Parish, Louisiana: Geology of the Tigre Lagoon Field," 49 P., 3 tables, 17 FIGS: McNeese State University, Lake Charles, La., 1978

Blowouts, cratered locations, fires, lost holes and lost rigs, stuck pipe, and "impenetrable formations", all associated with abnormally high subsurface fluid pressure, have delayed development of natural gas resources of the geopressure zone. Technology and equipment improvements by the mid-1950's made commercial development possible, and within a few years, thousands of geopressured natural gas reservoirs were in production. By 1960, it was realized that the producing characteristics of geopressured gas reservoirs differed markedly from those of hydropressure zone reservoirs, that the Pz versus cumulative production relationship was not linear, and that unproduced gas reserves could not be estimated by extrapolation of the Pz versus cumulative production curve. The term "Pz" is defined as the corrected gaseous pressure, in which "z" is the gas expansion correction coefficient for natural gas. The ideal value for "z" is 1.0, but for natural gas, which is a mixture comprising mostly methane, with ethane, propane, and butane, the value is frequently less than 1.0, depending upon the gaseous composition.

Data for several thousand geopressured gas reservoirs, now pubicly available, provided the basis for the concept leading to this invention. These records show that, during the early production period (usually the first few years) some pressure-sustaining mechanism causes the rate of reservoir pressure decline per unit of production to be somewhat less than the calculated volumetric rate; during an intermediate period, the rate of pressure decline per unit of production increases; and during a final period, the rate of pressure decline per unit of production corresponds to the conventional volumetric depletion-pressure drop. These changes are disclosed by Hammerlindl (1971). Also disclosed by Hammerlindl (1971) are (a) the calculated reserve based upon the initial slope of the Pz versus cumulative production curve, and (b) the calculated reserve based upon the final slope (volumetric depletion).

It is apparent from Hammerlindl (1971) that, by extrapolation of the calculated reserve from origin (Pz=6,060) at zero production to depletion of the reservoir (Pz=1,500) that some 11 Bcf (billion cubic ft) of natural gas was added to the gas reservoir and its associated bottom water during the productive life of the reservoir. The trend of the Pz versus cumulative production curve shows that most of this gas was added before the Pz value had dropped to 5,000. This is what would be expected to happen, as methane in gas-saturated formation waters associated with a gas reservoir comes out of solution as the pressure declines with production.

The mechanisms by which methane dissolved in water (1) exists in solution, (2) escapes from solution, and (3) migrates upward in colloidal-size bubbles is described in detail by Mac Elvain (1969, p. 15–27), who states that:

> . . . published theories of oil and gas migration . . . reveal a rather complete disregard for the basic physical laws which control the movement of gases in a sedimentary column . . . . Methane dissolves in water as individual $CH_4$ molecules, not as small bubbles of methane. Under the conditions of temperature and pressure existing in the sedimentary column, individual methane molecules do not have an affinity for each other. It is only at the point of liquification (at −160° C.) that methane molecules attract one another. In water, or water-filled sediments, methane is stable, inert, and behaves according to the laws which apply to an ideal gas. It is most important to understand that methane may be present in water in two different states—in solution and in suspension.

In solution, $CH_4$ exists as separate, completely individual molecules with nearly the same molecular weight as water. The molecular weight of methane is 16. The molecular weight of water is 18. Thus, methane dissolved in water will neither sink nor rise, but will merely move in all directions randomly with all net movement controlled only by the concentration gradient . . . . Methane molecules have absolutely no affinity for each other and . . . a methane gas bubble is not a group of millions of gaseous molecules working together in a common cause, but is merely a property of the cohesive forces of the water surrounding the gas . . . . Supersaturation is actually an environment in which more $CH_4$ molecules exist than the water can maintain with sufficient distance of separation to preserve them as individual methane molecules. The net result of supersaturation is that two or more methane molecules randomly collide and are forcibly rejected from their intolerable concentration in an elastic film of water surface that creates an exceedingly small gas bubble . . .

Vast numbers of such ultra-small gas bubbles are formed instantaneously when methane-saturated formation water in a sand-bed aquifer is subjected to a drop in fluid pressure. Because of their small size, these tiny gas bubbles are in continuous and random movement, as a consequence of endless collisions with water molecules. Because they contain only a few tens or hundreds of gas molecules, these bubbles are not spherical, and are constantly changing shape. They are instantly knocked loose from nearly everything they touch.

Mac Elvain adds that:

> In this manner, colloidal-size gas bubbles are readily displaced upward by the surrounding water at rates up to several millimeters per second regardless of any sedimentary particles that may intrude in the way of their upward zig-zag Brownian path. Such exceedingly small bubbles can quickly ascend hundreds or even thousands of feet in a manner not available to larger gas bubbles or to individual gas molecules.

Upward migration of the colloidal size bubbles, resulting from the density contrast between the bubbles and the surrounding water, is enhanced by their continuously changing shape; "kinetic jostling" enables them to worm through the interstices in sediments without becoming stuck to stationary sand or slit particles.

The tiny bubbles accumulate at the top of the sand-bed aquifer, displacing more and more water until critical gas saturation is reached. This gas then flows to, and becomes a part of, the producing gas reservoir—adding to its volume and sustaining its pressure.

The solubility of methane (natural gas) in water is very great at elevated pressures and temperatures. In the geopressure zone of the northern Gulf of Mexico Basin, and in all petroliferous geopressured basins of the world, formation waters are at or near natural gas saturation. The solubility curves disclosed in Sultanov, et al. (1972), show that fresh water at 10,000 psi, for example, can contain in solution 28 standard cubic ft per barrel (scf/bbl) at 220° F.; 41 scf/bbl at 300° F.; 77 scf/bbl at 400° F.; 149 scf/bbl at 500° F.; and 340 scf/bbl at 600° F. Solubilities of methane in the range 2,000 to 16,000 psi and 200° to 625° F. are shown in Table 1.

TABLE 1.

Solubilities of methane in water at selected temperatures and pressures, in standard cubic feet per barrel. (values approximate)

| Pressure | Temperature °F. | | | | | |
|---|---|---|---|---|---|---|
| psi | 200 | 300 | 400 | 500 | 600 | 656 |
| 2,000 | 10 | 12 | 20 | 30 | 17 | |
| 3,000 | 13 | 17 | 30 | 52 | 80 | |
| 4,000 | 15 | 23 | 40 | 76 | 135 | |
| 6,000 | 20 | 29 | 52 | 105 | 230 | 380 |
| 8,000 | 24 | 35 | 64 | 130 | 285 | 440 |
| 10,000 | 28 | 41 | 77 | 149 | 340 | 620 |
| 12,000 | | 47 | 86 | 168 | 400 | 800 |
| 14,000 | | 53 | 95 | 186 | 440 | 900 |
| 16,000 | | 58 | 104 | 200 | 480 | 1,000 |

These data and the curves in Sultanov, et al. (1972) support the observation of Perry (1972) that "the larger percentage of economical reserves (found to occur) at the higher pressure gradients reverses the previous concepts that geopressured reservoirs would contain small volumes of reserves." Unit decline of fluid pressure releases far greater amounts of gas (from water solution) at pressures between 4,000 and 12,000 psi and temperatures above 300° F., than at lower pressures and temperatures. At 400° F., volumes released by unit pressure drop are double those at 300° F.; at 500° F., they are quadruple; and at 600° F., they are an order of magnitude greater. Such releases of dissolved methane from high-temperature, high-pressure water associated with abnormally pressured (geopressured) natural gas reservoirs is believed to explain the two distinct slopes evident in plots of shut-in bottom-hole pressures versus cumulative production (Pz plot). Hammerlindl (1971) explains this change of slope, initially gentle and later steep, as the combined effect of changes due to gas expansion, formation compaction, crystal (rock) expansion, and water expansion. No mention is made of the effects of dissolved gas exsolution.

Hydrodynamically induced drop in fluid pressure in a methane-saturated aquifer as a consequence of high flow rates from a well, or wells that tap the aquifer, will cause dissolved methane to come out of solution as dispersed colloidal gas bubbles, in proportion to the numerical relations described in Sultanov, et al. (1972), and listed in Table 1. Continuing discharge from the well(s) causes progressive reduction of fluid pressure in the cone of pressure relief, progressive exsolution of methane, addition of vapor phase methane to the existing bubbles, and progressive expansion of the vapor-phase gas. As the percent of the aquifer pore space occupied by gas exceeds some critical value (50 percent, for example) the water/gas permeability ratio is reversed, and gas flow quickly dominates the fluid regime; water flow essentially stops.

The gas/water permeability ratio critical value will vary for a given aquifer, depending upon such factors as porosity and sand texture. The critical value can, however, usually be determined from test cores from the aquifer in question.

Concurrently with the shift to vapor phase flow, the cone of pressure relief created by the fluid withdrawals spreads very rapidly, because the permeability of reservoir rock to gas is generally an order of magnitude, or more, greater than it is to water. As this occurs, the rate of gas discharge increases markedly, and wells within the boundaries of the newly-created gas reservoir flow methane gas and water vapor. This gas flow continues as long as the expanding cone of pressure relief can cause methane exsolution from aquifer waters. However, after reaching a maximum discharge rate, the flow of gas from the created gas reservoir begins to decline as a result of (1) depletion of the dissolved gas content of aquifer waters within the cone of pressure relief, and (2) increasing distance (radial travel path) from the zone of exsolution to the discharge points (wells). Unless new wells within the area of the created gas reservoir, located at an optimum distance from the initial production wells, can now be opened and produced, the artificial gas reservoir will collapse: the initial production wells will water out, and their produced water will contain only residual amounts of dissolved gas.

Patents considered related to this invention are as follows.

U.S. Pat. Nos. 4,040,487 and 4,042,034 have identical specifications and drawings, and both relate to a process for producing natural gas which is unrecoverable by conventional methods. In applying the method to an appropriate geopressured reservoir, water is produced at a rate sufficient to lower the aquifer pressure and thereby release gas which will migrate and be produced. It is disclosed that it is desirable and necessary to produce water from wells at a very high production rate so as to reduce the formation pressure significantly and preferably as quickly as possible throughout as large an extent of the aquifer as possible. Due to this lowering of the aquifer pressure, gas will be released from solution with the water, will expand and join either the free gas phase dispersed in the water within the sand pores or the free gas present in a gas cap. It may even form a new gas cap if far enough removed from the well so that gravitational forces overcome differential pressure forces which normally cause the gas to flow toward the well. Because natural gas flows more easily through a porous formation than does water, gas will migrate if concentrations greater than residual gas exist. The residual gas concentration will be joined by released gas or expanded gas in the reservoir, and will come to the well bore to be produced with the water which also contains its solution gas. If the producing well is located in a formation close to a free gas phase attic, the lowering of the aquifer pressure can also cause the attic gas to expand and be produced at the well bore as the gas displaces the water and cones into the producing well. Condensate contained in the attic gas would additionally be produced along with the water and gas. A free gas cap remote from the producing well may be created or enlarged and it may be prudent to produce these areas in order to increase gas recovery from the reservoir and thereby to extract the maximum quantity of gas from it.

It is probable that the first targets for producing gas using the method of these prior patents will be the geopressured water sands (aquifers) that underlie and/or overlie producing conventional natural gas reservoirs of the geopressure zone, some 8,000 of which are now in commercial production in coastal and offshore Louisiana and Texas. In the Tigre Lagoon Field, Vermilion Parish, Louisiana, for example, six of eight water sands that occur between depths of 12,000 and 14,000 ft have produced free gas through conventional gas well completions, from wells located in several different parts of the structural high. The two water sands that had not been known to contain free gas were produced through the Edna Delcambre Well No. 1 of Coastal States Gas Producing Company after the well had been temporarily abandoned. Purchased by the United States Energy Research and Development Administration (now Department of Energy) in 1976, the well was recompleted to tap first the No. 3 sand, and later the No. 1 sand, for flow tests and natural gas content. Both sands yielded gas saturated water plus gas that is believed by Randolph (1977) to have occurred in the sand as dispersed bubbles in a low free gas saturation. The geology and hydrology of the field are described by Jones (1978) and the chemistry of produced gas, by Karkalits and Hankins (1977). Results support the assertion of Jones (1976) that all water sands of the geopressure zone in the northern Gulf of Mexico basin are methane saturated.

Contrary to the implications of U.S. Pat. Nos. 4,040,487 and 4,042,034 of Cook, et al., (1977) the most favorable prospects for development of natural gas from geopressured water sands containing low free gas saturations are not in the watered-out parts of produced gas reservoirs, where most of the solution gas originally present in the formation water has been exsolved by pressure drop, and produced to the gas cap.

An ideal candidate aquifer for gas production by this method should have:

(1) A high degree of geopressure and strong water drive.

(2) A moderate resistance to the flow of water and gas—through a range of permeability, for example, of from 20 to 200 millidarcy.

(3) A low free gas saturation, likely where the aquifer is overlain or underlain by conventional gas reservoirs.

(4) Existing gas wells in the vicinity which are still usable for either production or reinjection of water. (5) A shallow salt water aquifer suitable for disposal of produced water.

(6) Attic gas upstructure in the aquifer, perhaps remaining after cessation of production by conventional means.

(7) A high condensate to gas ratio in the attic.

U.S. Pat. No. 2,077,912 discloses the use of a removable packer in a gas well.

U.S. Pat. No. 2,736,381 discloses the use of a packer (24) in an oil or gas well.

U.S. Pat. No. 2,760,578 discloses the use of a packer in an oil well.

U.S. Pat. No. 2,973,811 discloses the drilling of a plurality of wells in a "line drive pattern" in an aquifer containing carbonaceous matter.

U.S. Pat. No. 3,134,438 discloses the use of a packer (34) in an oil well and further discloses fluid coning.

U.S. Pat. No. 3,215,198 discloses the use of a plurality of wells for gas injection pressure maintenance.

U.S. Pat. No. 3,302,581 discloses the use of an inflatable, retrievable packer lifted by gas pressure.

Other United States Patents which do not appear to be as relevant as those above, are: U.S. Pat. No. 1,272,625; 2,230,001; 2,258,615; 3,123,134; 3,177,940; 3,215,199; 3,258,069; 3,330,356, and 3,382,933.

SUMMARY OF THE INVENTION

This invention relates to a method of gas production from wells drilled into geopressure aquifers containing methane-saturated water. The method comprises drilling an initial well which has associated control means that permit an initial flow of water with a substantial absence of back pressure at the well head. The flow of water is continued until the loss of pressure in the aquifer results in sufficient gas exsolution to cause a reversal of the gas/water permeability ratio. At that point, the flow is converted to natural gas and water vapor, and a gas cap is created. The substantial absence of back-pressure is maintained during gas production. The presence of appreciable back-pressure during gas production will result in premature diminishing of the gas cap and cause the cessation of gas production. The gas cap will have the approximate shape of an inverse cone. Withdrawal of gas from the well is continued, until the surrounding water becomes substantially gas-free, during the course of which the pressure in the gas cap is reduced to the point at which the gas/water interface begins to rise, diminishing the depth/volume of the gas cap.

At this stage, additional wells in the same aquifer approximately equidistant from the initial well, and approximately equidistant from each other, are drilled and produced. These wells are located along an imaginary circle whose approximate center is the initial well, and constitute a "first ring." The wells of the first ring can number between three and eight or more, depending upon aquifer conditions and the distance of the wells from the initial well. The wells of the first ring must be sufficiently close to each other and to the initial well so that the gas cap formed by each well intercepts the gas caps formed by each adjacent well and the initial well. The wells of the first ring, and all wells of successive rings, are of the same type as the initial well. The identical method of production for the initial well is repeated for all of the wells of the first ring. It is preferred that production from all of the wells of the first ring begin at approximately the same time, so as to create similar conditions in the aquifer for the entire portion below the first ring well heads. When the wells of the first ring are at maximum production, they will each produce approximately the same amount of natural gas as was produced by the initial well at its maximum.

Eventually, the gas production of the first ring will exsolve sufficient gas from the gas-satuated aquifer water to cause a reduction of gas production from the first ring, and a virtual cessation of production from the initial well. At or before this point, the initial well is capped and a second (imaginery) ring of wells is drilled and produced. These wells are drilled approximately equidistant from the first ring and approximately equidistant from each other. These second ring wells are located on an imaginary circle whose approximate center is the initial well, that is, which is approximately concentric with the first ring. The method of production for the second ring is substantially the same as for the first ring.

The effect of this method may be explained in terms of the gas cap. Thus, a gas cap reservoir in the shape of an inverse cone is formed by the initial well. This gas cap is at its maximum depth/volume at approximately the same time period that gas production from the initial well is at its maximum. The gas cap is then expanded outward to include the gas caps formed by the wells in the first ring, with a shift of the locus of maximum depth/volume from a point centered at the initial well to an imaginary circle beneath the first ring. When the second ring of wells is drilled and produced, and the initial well is capped, the locus of maximum depth/volume of the gas cap is again shifted outwards, from a circle beneath the first ring to an imaginary circle beneath the second ring.

After gas production in the second ring begins to decrease, gas production from the first ring will become increasingly cost ineffective. This is an indication of the increasing depletion of dissolved natural gas in the aquifer waters drawn upon by the wells of the second ring. At this point, a third concentric ring of wells is drilled, and the first ring of wells is capped. This process is continued using a plurality of rings, until the dissolved gas in the aquifer is depleted, that is, until gas production from the aquifer is no longer cost effective.

This dynamic process may be considered as analogous to the ripple effect of a single circular wavelet formed by dropping a pebble into a pond of calm water.

BRIEF DESCRIPTION OF THE DRAWINGS

FIG. 4*a* illustrates a typical overhead view of the relative positions of the initial well and wells of the first ring, in accordance with this invention.

FIG. 4*b* illustrates a typical side planar view of the initial well and of two diametrically opposed wells of the first ring, showing the relative depths of the wells' respective gas caps and their mutual intercept effect, in accordance with this invention.

FIG. 5*a* illustrates a typical overhead view of the relative positions of the initial well and wells of the first, second, and third rings, in accordance with this invention.

FIG. 5*b* illustrates a typical side planar view of the initial well and of two diametrically opposed wells of each of the first, second, and third rings, showing the relative depths of the wells' respective gas caps and their mutual intercept effect, in accordance with this invention.

DESCRIPTION OF THE PREFERRED EMBODIMENTS

Figure 1:
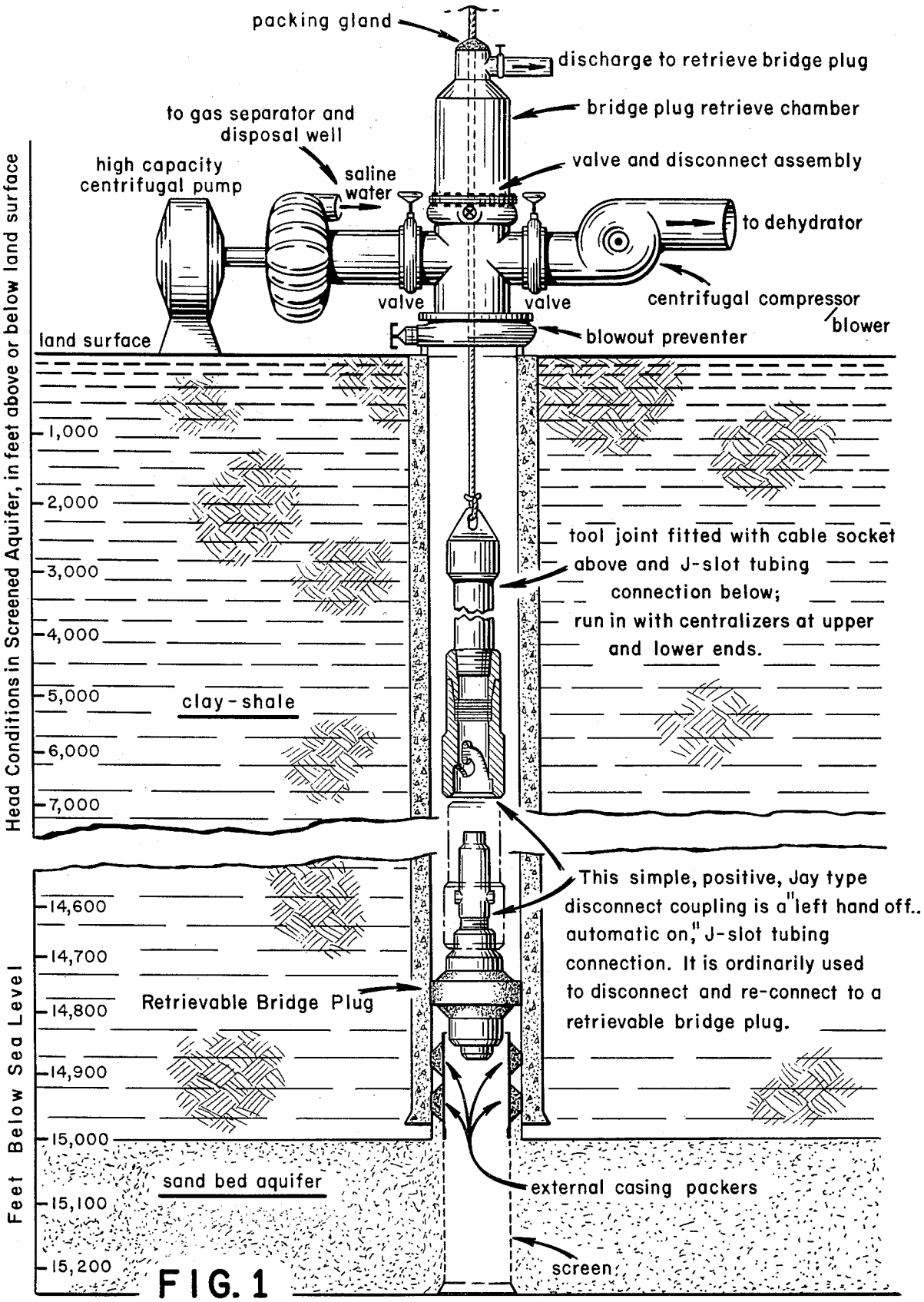
FIG. 1 illustrates a side planar view of a typical well designed to produce fluids under controlled blowout conditions, in accordance with this invention.

FIG. 1 is an illustration of a typical well, in accordance with this invention. The well can have a conventional casing and a conventional liner, although a heavy-duty liner is preferred. The liner is also preferably coated with a substance, typically a vinyl plastic, which will prevent corrosion and reduce the coefficient of fraction, and thereby increase the flow rate. The liner and casing is used up to the point at which the well bore enters the aquifer. The portion of the well bore penetrating into the aquifer is fitted with a screen instead of a liner.

The screen is of the type conventional for water wells in sand aquifers, but is usually not employed in oil or gas wells, except when serious sanding problems exist. Such a screen typically consists of a wire-wrapped perforated pipe in which 40 to 60% of the surface area is removed by equally spaced drill holes, generally one-quarter to three-quarter inches in diameter. The pipe is fitted with evenly spaced longitudinal stringers on the outside. The body of the pipe is wrapped with a winding of trapezoidally cross-sectioned wire, placed so that the base of the trapezoid is on the outside, and spaced apart so that the slot formed between the windings is sufficient to pass only the 70% fines of the sand. This screen acts to permit the methane-saturated liquid and the gas of the aquifer to enter into the well, without admitting sufficient sand particles to clog the well. In another embodiment, the aquifer may be tapped by open hole completion if it is composed of a strata that requires no screen, such as cemented sandstone.

A well of conventional 13⅝ inches diameter may be used, but larger wells, having a diameter up to about 18 inches are preferred. A large-capacity water well, as is contemplated in this invention, is designed to flow at rates approaching "blow out" conditions, that is, having almost zero back pressure at the well head.

The wells to be used in the method of this invention also differ from conventional wells in that they incorporate means for initially blocking the flow of gas and/or water, associated cooperatively with the well bore. Any such blocking means is acceptable, provided that it is equally capable both of substantially stopping all gas and/or water flow and of permitting water and gas flow when desired. Such a means could therefore be a controllable diaphragm or large capacity valve fitted within the well bore at a point above the sand screen, and which can be opened by control means located at the surface.

A preferred embodiment is the use of an inflatable, retrievable packer or bridge plug, to be set a short distance above the sand screen, and to be retrieved by a disconnect-reconnect coupling mounted on a tool-joint sinker bar run on a cable. A typical example of such an embodiment is shown in FIG. 1, although this invention is not limited to the illustrated apparatus. The inflatable, retrievable bridge plug, disconnect-reconnect coupling, and related equipment can be obtained from various manufacturers, among which is Lynes, Inc., of Houston, Texas.

The preferred procedure to be followed in completing the wells is as follows. With heavy-duty well casing bottomed and cemented in place about 20 ft above the top of the aquifer to be produced, the hole is deepened to accommodate the sand screen, using an invert mud of suitable weight. The screen is run below an appropriate length of blank pipe of the same outside diameter, on which two external casing packers (Lynes Model RTS, Product No. 301-03 or equivalent) are set in tandem (see FIG. 1), so as to be positioned inside (telescoping) the lower part of the well casing. The top of the screen is set at the top of the aquifer. After inflation of the external casing packers (See FIG. 1), the annulus between the casing and the tubing is closed at the well head, and the packer set is pressure tested to equal the shut-in pressure of the screened aquifer plus 10 percent. The tubing is then disconnected from the screen-packer assembly (preferably by means of a left-hand-off coupling located immediately above the upper external casing packer), and removed from the well.

A retrievable bridge plug fitted with a disconnect coupling (Lynes Product No. 300-75 or equivalent) is then run on tubing to a depth up to 100 ft and preferably 20 to 40 ft above the sand screen-tandem packer assembly. (See FIG. 1.) The plug is inflated, and the annulus between the casing and tubing is closed at the well head; the packer set is again pressure tested to equal the shut-in pressure of the screened aquifer plus 10 percent. The tubing is then disconnected from the retrievable bridge plug by rotation, using a left-hand-off . . . automatic on, J-slot tubing connection located immediately above the bridge plug. The tubing is raised one joint, and the heavy drilling mud is circulated out of the well ahead of salt water from a disposal well. The tubing is then removed from the well.

A production ("Christmas") tree is then fitted to the well head. This tree is designed to withstand exposure to the closed-in fluid pressure of the screened aquifer with a gas-filled well. It is also designed with a bridge-plug retrieval chamber, at the top of which is a high-pressure packing gland through which the plug retrieval cable passes (See FIG. 1.), and at the bottom of which is a valve and disconnect assembly. The plug retrieval chamber is replaced by a high pressure "kill" line connection for emergency use.

The automatic J-slot tubing connector, designed to re-connect to the retrievable bridge plug, is mounted on a half-joint of drill stem fitted with centralizers at top and bottom. This assembly is hung on a bail with cable connection, and run several hundred feet into the well. All well-head fittings are completed; connections to pumps and flow lines are made, and all valves checked. The well head is closed and pressure tested to the maximum expected closed-in pressure during operations. Pressures above and below the bridge plug (packer) are then equalized.

Soundness of the well and well-head having been confirmed, the automatic J-slot tubing connector is lowered on cable to the bridge plug, connection is established, and the shear-pin of the retrievable bridge plug is sheared by an appropriate tug on the cable. Deflation of the bridge-plug packer is immediate, and the plug is withdrawn from the well, lifted into the packer retrieval chamber, and the valve beneath it is closed. The well is now ready to produce.

High-capacity pumping means are provided at the well head, adequate to maintain the substantial absence of back-pressure. The pumping means should have the capacity to handle a multiphase (water/gas) flow, but may otherwise be conventional. A high-capacity centrifugal pump system having several pumps may typically be used.

The valve to the high-capacity centrifugal pump system, with bypass to a gas separator and disposal well, is slowly opened to avoid pressure surges, and the rate of flow is gradually increased, thus causing no excessive stress on the well screen. Flow is allowed to increase in increments of about 100 gallons per minute in each subsequent 30 minute periods until the full capacity of the well is reached. Back-pressure at the well-head is then decreased gradually by drawing off flow through the large-capacity centrifugal pumps, which discharge through the gas separators to a second disposal-well system. The pumping rate is increased until the well-head back-pressure is reduced approximately to zero.

As well discharge continues, the gas/water ratio will increase progressively until the water flow begins to come in surges. The well-head pumps are then bypassed and shut down, and the flow of the well is diverted directly to the gas separators; associated water being pumped to the disposal wells.

When water surges cease, the flow from the well—now entirely gas—is diverted through large-capacity gas pumping equipment which reduces the well-head pressure to atmospheric, or below. This equipment may be the same pumps used for the water, if multiphase, or may be separate pumps. These pumps continue to operate as long as vapor-phase flow continues.

Figure 2:
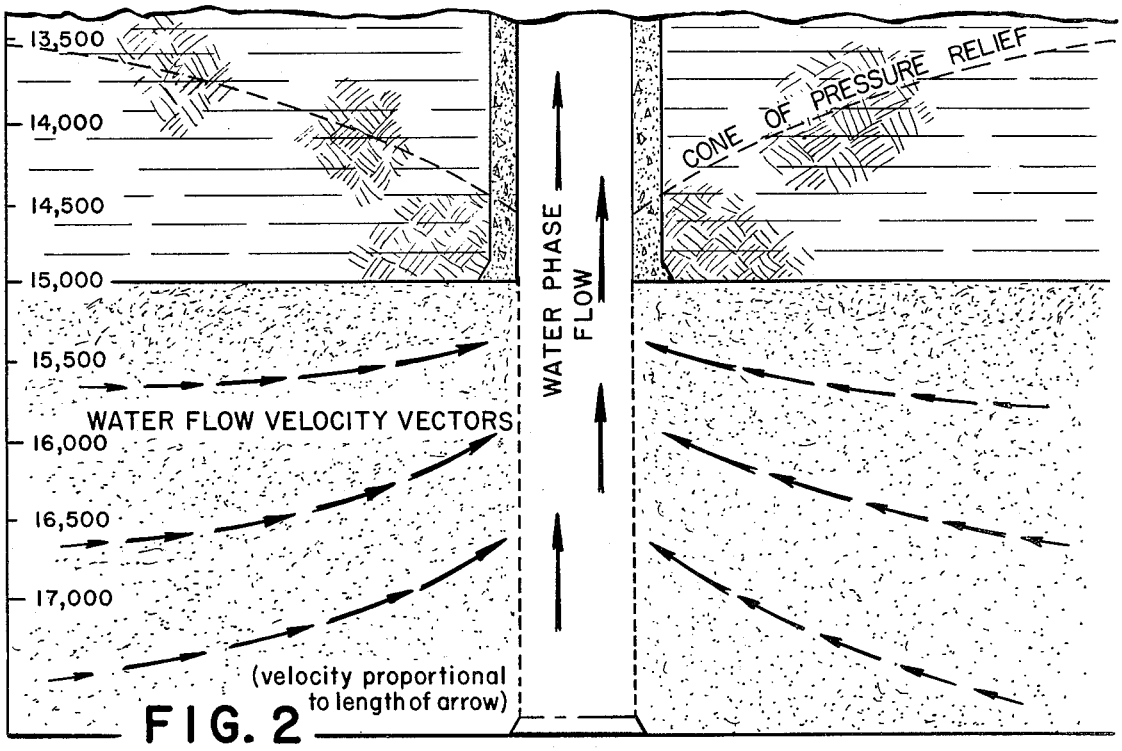
FIG. 2 illustrates typical aquifer conditions during initial gas production before the formation of a gas cap reservoir, in accordance with this invention.

FIG. 2 shows the water phase flow a few days after the controlled blowout is established. The water flow velocity is greater as the water approaches the well bore. The water, at this stage, flows up the well bore, and is produced at the well head. At this point, the dissolved methane may be exsolved from the water and recovered by any conventional method. The water may be disposed of in any suitable conventional manner, one possibility being the use of the recovered methane to power pumping of the water into suitable hydropressure zone reservoirs, another being to use the geothermal energy of the water.

Figure 3:
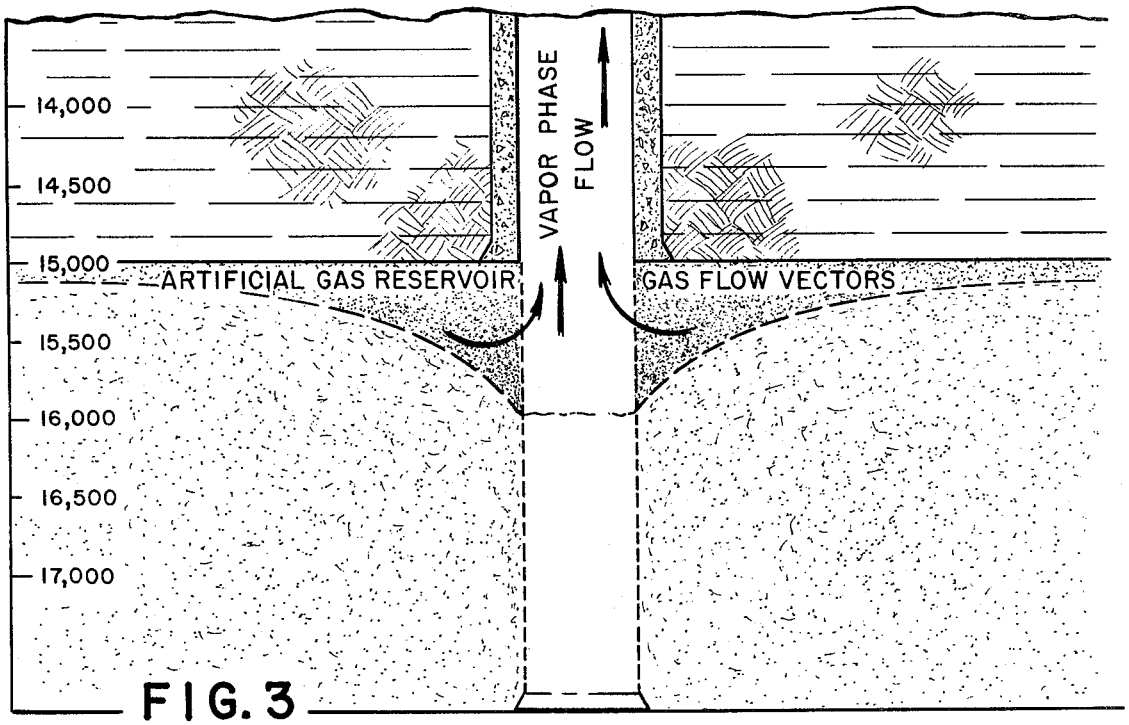
FIG. 3 illustrates typical aquifer conditions during maximum gas production and when the gas cap reservoir is at maximum depth/volume, in accordance with this invention.

FIG. 3 shows a typical well/aquifer configuration after the water phase has ended and continuous natural gas production has begun. This stage, which may occur a few weeks after the controlled blowout is established, may generate occasional water slugs forced up from the well bottom when the gas cap is not yet fully established. Once the gas cap is sufficiently large, water slugs should no longer occur.

It is impossible to state the exact distance that each well should be from each other well, or the distance that each ring of wells should be from each previous ring. Such distances will depend upon variable aquifer factors including: (1) hydraulic characteristics; (2) temperature; (3) geopressure; (4) water salinity; (5) formation porosity; (6) degree of saturation; (7) physical dimensions; and (8) the existence, location, and nature of faults.

FIG. 4(*a*) shows a typical overhead view of the relative positions of initial well 1 and wells 2, 3, 4, and 5, which constitute the first ring. The wells of the first ring, which are not limited to the number illustrated, form a ring b which is approximately concentric with the initial well 1. FIG. 4(*b*) is a side planar view corresponding to FIG. 4(*a*), showing only wells 1, 3 and 5. The well bores d are drilled from the land surface c past the upper level of the aquifer e. The gas caps formed by the wells 1, 2, 3, 4, and 5 interact to form a continuous gas cap with a gas/water interface f, whose outer edge a has the general form of a concentric circle when viewed from overhead, as shown in FIG. 4(*a*).

FIG. 5(*a*) is similar to FIG. 4(*a*), but illustrates a later stage of the aquifer's production. In FIG. 5(*a*), wells 6, 7, 8, 9, 10, 11, 12 and 13 constitute a second ring g and wells 14, 15, 16, 17, 18, 19, 20, 21, 22, 23, 24, 25, 26, 27, 28 and 29 constitute a third ring h. The wells of the second ring g and the third ring h are not limited to the number illustrated, and the rings are approximately concentric with the initial well 1. FIG. 5(*b*) is a side planar view corresponding to FIG. 5(*a*), showing only wells, 1, 3, 5, 8, 12, 18 and 26. The gas caps formed by the wells interact to form a continuous gas cap whose gas/water interface f has an outer edge a. In FIGS. 5(*a*) and 5(*b*) the water surrounding the initial well 1 has been essentially depleted of dissolved gas, as the result of which initial well 1 has been capped and the gas cap portion surrounding it has been replaced by gas-depleted water. Disappearance of the gas cap portion surrounding initial well 1 has caused the appearance of a gas cap inner edge a′, which appears in both FIGS. 5(*a*) and 5(*b*). The inner edge a′ thus defines an inner volume of substantially gas-depleted water within the gas cap bounded by the gas/gas-depleted-water interface.

As the production method of this invention is continued, a plurality of additional rings of gas wells is drilled, as the result of which both gas cap outer edge a and the gas cap inner edge a′, as shown typically in FIGS. 5(*a*) and 5(*b*), will each continue to expand associatively. Thus, as additional rings of wells are added, the gas in the waters under the first ring will become substantially depleted, as the result of which the wells of the first ring will be capped, and this process will continue for succeeding rings, as the gas production of each ring falls below cost effectiveness. This pattern of production is an ideal model and cannot be followed in all instances. Thus, a given aquifer may have a volumetric configuration such that the wells on one side of a ring may continue in production longer than the wells on the opposite side. This may distort the pattern of subsequent rings of wells from the ideal concentric circle. The broad general principle of production will not change, however, that being continued expansion of the interacting gas cap by the addition of new wells, with the capping of contiguous insufficiently productive old wells.

The use of the rings of wells is also governed by the natural boundaries of the aquifer. No wells are drilled into that portion of the ring which lies outside the aquifer. For this reason, the initial well should be as close to the center of the aquifer as possible. The concentric rings of wells are thus expanded outwards to the boundaries of the aquifer.

A fault in the aquifer will act similarly to the edge of the aquifer, where the flow of gas and/or water is impeded by such a fault. For this reason, the existence of faults should also be considered in determining the optimum positioning of the initial well.

Where an aquifer is unusually long or extensive, it is possible to employ the method of this invention in more than one part of the aquifer simultaneously, by drilling more than one initial well and subsequent rings of wells. It is preferred that the gas caps thus created not interact with one another until that portion of the aquifer waters not lying between the initial wells is substantially gas depleted.

I claim:

1. A method of natural gas production from wells having a well-bore and well-head and which are drilled into geopressured gas-saturated aquifers, comprising the steps of:

(A) permitting an initial flow of geopressured gas-saturated water;

(B) causing a substantial absence of back-pressure at the well-head by drawing off flow by pumping;

(C) continuing the flow of gas-saturated water until water slugs appear at the well-head, to indicate reversal of the gas/water permeability ratio and creation of a gas cap whose edge is the gas/saturated-water interface; and (D) maintaining the absence of back-pressure by pumping to permit a maximum continuous flow of natural gas.

2. The method of claim 1 further comprising the steps, prior to permitting the initial flow of geopressured gas-saturated water, of:

(1) permitting the free flow of gas-saturated water into the well;

(2) using fluid flow control means located within the well bore to prevent the flow of fluid;

(3) equalizing the pressure in the well bore above and below the fluid control means;

(4) operating the fluid control means to permit fluid flow; and then (5) beginning and gradually increasing the flow of gas-saturated water, until the full flow capacity of the well under atmospheric pressure is achieved.

3. The method of claim 2, wherein step (2) further comprises:

(a) inserting fluid flow control means within the well-bore at a point between the top of the aquifer and the well-head;

(b) completing and closing the well-head; and (c) engaging the fluid flow control means to prevent the flow of fluid.

4. The method of claim 3 further comprising the steps, subsequent to permitting the initial flow of geopressured gas-saturated water, of:

(6) pumping out the water at the well-head at a gradually increasing rate, so as to cause the substantial absence of back-pressure; and (7) maintaining the substantial absence of backpressure after gaseous flow commences.

5. The method of claim 4, wherein the free flow of gas-saturated water into the well is facilitated by fitting a sand screen to that portion of the well-bore penetrating into the aquifer.

6. The method of claim 6, wherein the fluid flow control means is an inflatable retrievable bridge plug which is placed at a point not more than about 100 feet above the top of the aquifer and inflated sufficiently to withstand a pressure greater than the geopressure of the aquifer; and which is operated to permit fluid flow by removal from the well bore by deflation, retrieval by means of a cable connected between the bridge plug and the well head, and storage within the well head.

7. The method of claim 6, wherein the gas is permitted to flow until the water surrounding a gas cap formed under an initial well is at least partially gas-depleted, whereupon additional wells of the same nature are drilled approximately equidistant from the initial well and approximately equidistant from each other, said additional wells being located approximately along an imaginary circle approximately concentric with the first well and constituting a first ring, with the proviso that the wells of the first ring are sufficiently close to each other and to the first well, so that the gas cap formed by each well intercepts the gas cap formed by each adjacent well, thus forming a single gas cap.

8. The method of claim 7, wherein after production from the wells of the first ring has exsolved sufficient natural gas from the aquifer water surrounding the gas cap so as to cause a reduction of gas production from the first ring and a substantial cessation of gas production from the initial well, the initial well is capped to form an inner volume of substantially gas-depleted water within the gas cap whose gas/gas-depleted-water interface forms an inner edge of the gas cap, and additional wells of the same nature are drilled approximately equidistant from the first ring and approximately equidistant from each other, said additional wells being located approximately along an imaginary circle approximately concentric with the first ring and constituting a second ring, with the proviso that the wells of the second ring are sufficiently close to each other and to the wells of the first ring, so that the gas cap formed by each well intercepts the gas cap formed by each adjacent well and the existing gas cap.

9. The method of claim 8, wherein a plurality of additional concentric rings of increasing diameter of gas wells of the same nature and spaced apart in the same manner are drilled, with the proviso that not more than five adjacent concentric rings of gas wells are simultaneously in production, and with successive capping of the wells of inner rings, so as to form a single gas cap having a continuously expanding outer edge and an associatively continuously expanding inner edge.

10. The method of claim 13, wherein not more than three adjacent concentric rings are simultaneously in production.

11. The method of claim 14, wherein the concentric rings are broken by the outer boundaries of the aquifer, so that no wells are drilled outside of the aquifer.

12. The method of claim 11, wherein the concentric rings are broken by faults in the aquifer, so that no wells are drilled on the other side of the faults from the initial well.

13. The method of claim 2 further comprising the steps, subsequent to permitting the initial flow of geopressured gas-saturated water, of:

(6) pumping out the water at the well-head at a gradually increasing rate, so as to cause the substantial absence of back-pressure; and (7) maintaining the substantial absence of back-pressure after gaseous flow commences.

14. The method of claims 2 or 3, wherein the free flow of gas-saturated water into the well is facilitated by fitting a sand screen to that portion of the well-bore penetrating into the aquifer.

15. The method of claims 2, 3 or 4, wherein the fluid flow control means is an inflatable retrievable bridge plug which is placed at a point not more than about 100 feet above the top of the aquifer and inflated sufficiently to withstand a pressure greater than the geopressure of the aquifer; and which is operated to permit fluid flow by removal from the well bore by deflation, retrieval by means of a cable connected between the bridge plug and the well head, and storage within the well head.

16. The method of claims 1, 2, 3, 4, 5 or 6, wherein the gas is permitted to flow until the water surrounding a gas cap formed under an initial well is at least partially gas-depleted, whereupon additional wells of the same nature are drilled approximately equidistant from the initial well and approximately equidistant from each other, said additional wells being located approximately along an imaginary circle approximately concentric with the initial well and constituting a first ring, with the proviso that the wells of the first ring are sufficiently close to each other and to the initial well, so that the gas cap formed by each well intercepts the gas cap formed by each adjacent well, thus forming a single gas cap.

17. The method of claims 10, 12 or 13, wherein the concentric rings are broken by the outer boundaries of the aquifer, so that no wells are drilled outside of the aquifer.

18. The method of claims 7, 8, 9 or 10, wherein the concentric rings are broken by faults in the aquifer, so that no wells are drilled on the other side of the faults from the initial well.

19. A method of gas production from geopressured gas-saturated aquifers using wells which have a substantial absence of back-pressure at the well-head resulting in formation of a gas cap in the aquifer surrounding the well, comprising removing gas until the water surrounding the gas cap formed under an initial well is at least partially gas-depleted, whereupon additional wells of the same nature are drilled approximately equidistant from the initial well and approximately equidistant from each other, said additional wells being located approximately along an imaginary circle approximately concentric with the first well and constituting a first ring, with the proviso that the wells of the first ring are sufficiently close to each other and to the first well, so that the gas cap formed by each well intercepts the gas cap formed by each adjacent well, thus forming a single gas cap.

20. The method of claim 19, wherein after production from the wells of the first ring has exsolved sufficient natural gas from the aquifer water surrounding the gas cap so as to cause a reduction of gas production from the first ring and a substantial cessation of gas production from the initial well, the initial well is capped to form an inner volume of substantially gas-depleted water within the gas cap whose gas/gas-depleted-water interface forms an inner edge of the gas cap, and additional wells of the same nature are drilled approximately equidistant from the first ring and approximately equidistant from each other, said additional wells being located approximately along an imaginary circle approximately concentric with the first ring and constituting a second ring, with the proviso that the wells of the second ring are sufficiently close to each other and to the wells of the first ring, so that the gas cap formed by each well intercepts the gas cap formed by each adjacent well and the existing gas cap.

21. The method of claim 20, wherein a plurality of additional concentric rings of increasing diameter of gas wells of the same nature and spaced apart in the same manner are drilled, with the proviso that not more than five adjacent concentric rings of gas wells are simultaneously in production, and with successive capping of the wells of inner rings, so as to form a single gas cap having a continuously expanding outer edge and an associatively continuously expanding inner edge.

22. The method of claim 21, wherein not more than three adjacent concentric rings are simultaneously in production.

23. The method of claim 22, wherein the concentric rings are broken by the outer boundaries of the aquifer, so that no wells are drilled outside of the aquifer.

24. The method of claims 19, 20 or 21, wherein the concentric rings are broken by the outer boundaries of the aquifer, so that no wells are drilled outside of the aquifer.

25. The method of claim 23, wherein the concentric rings are broken by faults in the aquifer, so that no wells are drilled on the other side of the faults from the initial well.

26. The method of claims 19, 20, 21 or 22, wherein the concentric rings are broken by faults in the aquifer, so that no wells are drilled on the other side of the faults from the initial well.

27. An apparatus for natural gas production from wells having a well-bore and well-head and which are drilled into geopressured gas-saturated aquifers, comprising:

(a) fluid flow control means located within the well-bore to prevent the flow of fluid;

(b) means for equalizing the pressure in the well-bore above and below the fluid flow control means;

(c) means for operating the fluid flow control means to permit fluid flow;

(d) means for permitting an initial flow of geopressured gas-saturated water;

(e) means for causing a substantial absence of back-pressure at the well-head and for continuing the flow of gas-saturated water until wafter slugs appear at the well-head to indicate reversal of the gas/water permeability ratio and creation of a gas cap whose outer edge is the gas/saturated-water interface; and (f) means for maintaining the absence of back-pressure to permit a maximum continuous flow of natural gas.

28. The apparatus of claim 27, wherein the fluid flow control means further comprises:

(g) fluid flow control means inserted within the well-bore at a point between the top of the aquifer and the well-head;

(h) means for completing and closing the well-head; and (i) means for engaging the fluid flow control means to prevent the flow of fluid.

29. The apparatus of claim 27 further comprising (g) means for pumping out the water at the well-head at a gradually increasing rate, so as to cause the substantial absence of back-pressure subsequent to permitting the initial flow of geopressured gas-saturated water; and (h) means for maintaining the substantial absence of back-pressure after gaseous flow commences.

30. The apparatus of claim 27 further comprising a sand screen fitted to that portion of the well-bore penetrating into the aquifer.

31. The apparatus of claim 27 wherein the fluid flow control means is an inflatable retrievable bridge plug placed at a point not more than about 100 feet above the top of the aquifer and being inflatable sufficiently to withstand a pressure greater than the geopressure of the aquifer, said bridge plug being deflatable to permit removal from the well-bore to permit fluid flow, said bridge plug being connected to the well-head with a cable to permit retrieval and storage.

32. A system for gas production from geopressured gas-saturated aquifers using wells which have a substantial absence of back-pressure at the well-head resulting in formation of a gas cap in the aquifer surrounding the well, comprising means for removing gas until the water surrounding the gas cap formed under an initial well is at least partially gas-depleted, and additional wells of the same nature drilled approximately equidistant from the initial well and approximately equidistant from each other, said additional wells being located approximately along an imaginary circle approximately concentric with the first well and constituting a first ring, with the proviso that the wells of the first ring are sufficiently close to each other and to the first well so that the gas cap formed by each well intercepts the gas cap formed by each adjacent well, thus forming a single gas cap.

33. The system of claim 32, including means for capping the initial well to form an inner volume of substantially gas-depleted water within the gas cap whose gas/-gasdepleted-water interface forms an inner edge of the gas cap, and additional wells of the same nature drilled approximately equidistant from the first ring and approximately equidistant from each other, said additional wells being located approximately along an imaginary circle approximately concentric with the first ring and constituting a second ring, with the proviso that the wells of the second ring are sufficiently close to each other and to the wells of the first ring so that the gas cap formed by each well intercepts the gas cap formed by each adjacent well and the existing gas cap.

34. The system of claim 33, including a plurality of additional concentric rings of increasing diameter of gas wells of the same nature drilled and spaced apart in the same manner with the proviso that not more than five adjacent concentric rings of gas wells are simultaneously in production, and including means for the successive capping of the wells of inner rings, thereby forming a single gas cap having a continuously expanding outer edge and an associatively continuously expanding inner edge.

35. The system of claim 34, wherein the concentric rings are broken by the outer boundaries of the aquifer with no wells drilled outside of the aquifer.

36. The system of claim 35, wherein the concentric rings are broken by faults in the aquifer with no wells drilled on the other side of the faults from the initial well.

* * * * *

UNITED STATES PATENT AND TRADEMARK OFFICE

CERTIFICATE OF CORRECTION

PATENT NO. : 4,279,307

DATED : July 21, 1981

INVENTOR(S) : Paul H. JONES

It is certified that error appears in the above—identified patent and that said Letters Patent is hereby corrected as shown below:

In Section [56] under OTHER PUBLICATIONS, line 7, change "Hammerlindly" to --Hammerlindl--.

In Section [57] under ABSTRACT, line 5, change "containing" to --continuing--.

Column 3, lines 28-47 should be indented.

Column 7, line 65, delete "(imaginery)".

Column 9, line 5, change "fraction" to --friction--.

Signed and Sealed this

*Twenty-second* Day of *December 1981*

[SEAL]

*Attest:*

GERALD J. MOSSINGHOFF

*Attesting Officer*

*Commissioner of Patents and Trademarks*